United States Patent [19]

Peterson

[11] Patent Number: 4,577,474

[45] Date of Patent: Mar. 25, 1986

[54] THERMALLY INSULATED HOLDER FOR A SINGLE BEVERAGE CAN

[76] Inventor: Walter E. Peterson, Box 696, Diablo, Calif. 94528

[21] Appl. No.: 706,939

[22] Filed: Feb. 28, 1985

[51] Int. Cl.[4] ..... F25D 3/08

[52] U.S. Cl. ..... 62/457; 220/4 E; 220/901

[58] Field of Search ..... 220/4 E, 901; 62/457, 62/372

[56] References Cited

U.S. PATENT DOCUMENTS

| | | | |
|---|---|---|---|
| 1,723,731 | 8/1929 | Hafling | 224/148 |
| 2,464,069 | 3/1949 | Benson . | |
| 2,652,698 | 9/1953 | Schlumbohm | 62/457 |
| 2,731,182 | 1/1956 | Higgins . | |
| 3,032,224 | 5/1962 | Lou | 215/13 R |
| 3,120,319 | 2/1964 | Buddrus | 215/13 |
| 3,406,532 | 10/1968 | Rownd et al. | 62/457 |
| 3,703,816 | 11/1972 | Weathers | 62/457 |
| 4,197,890 | 4/1980 | Simko | 150/2.2 |
| 4,228,908 | 10/1980 | Tweeton | 215/11 C |
| 4,383,422 | 5/1983 | Gordon et al. | 62/457 |

*Primary Examiner*—Lloyd L. King

*Attorney, Agent, or Firm*—Norman B. Rainer

[57] ABSTRACT

A thermally insulated holder for accommodating a single beverage-containing can of standard size is comprised of two identical mating halves, each half comprised of an integral monolithic jacket fabricated of a closed cell foam of a resilient polymer, and a refrigerant container positioned at the bottom of the jacket. The refrigerant container is adapted to confine a refrigerant liquid. The two halves are adapted to be brought together in sealing abutment about the beverage-containing can. Grooves within the jacket conduct the cooling effect of the refrigerant to the beverage-containing can.

4 Claims, 3 Drawing Figures

THERMALLY INSULATED HOLDER FOR A SINGLE BEVERAGE CAN

BACKGROUND OF THE INVENTION

The present invention relates to a container adapted to accommodate a single beverage-containing can and maintain said beverage at a low temperature.

Various easily carried insulated beverage container holders are known for cooling or retarding the warming of potable liquids during their consumption. Although generally effective, said earlier holders are usually of expensive multi-component construction, or are difficult to use, or have been designed to accommodate bottle-type beverage containers. Thin-walled aluminum beverage cans of currently popular design cannot be accommodated by most holder devices of the prior art. Such cans necessitate different design considerations. For example, whereas a bottle generally has a neck which facilitates manipulation for insertion into or removal from a close-fitting holder, the can provides less opportunity for gripping by the user.

In use of insulated beverage container holders in recreational activities, such as while golfing, fishing, swimming, or observing or participating in other sport events, it is a typical practice to place a prechilled canned or bottled beverage in the insulated holder for its consumption by the individual. The purpose of the beverage container holder is to maintain the cooled or chilled beverage in a cold or chilled condition for a longer period of time, i.e., retard its warming, than would otherwise be the case if the beverage container were exposed directly to the surrounding environment. The retention of the cooled or chilled condition of the beverage for a longer period of time is desirable, particularly where the beverage may not be palatable when warm, or may be drunk slowly, as when the beverage is consumed during the course of participation in activities, such as swimming, fishing, playing a round of golf, or the like.

In insulated beverage container holders which employ a freezeable liquid, such as the aqueous methyl cellulose, glycerines, and glycol-type compositions, hereinafter referred to as a refrigerant, the liquid refrigerant is frozen in the freezer compartment of a refrigerator, and subsequently used to keep the beverage cooler for a longer period of time than do those insulated holders containing no refrigerant.

In uses involving outside recreational acitivities of extended duration, it can be appreciated that it is desirable that a beverage container holder provide insulation and retard warming of the beverage as long as possible during its use, even when a refrigerant material therein begins to reach ambient temperature. It is further highly desirable that such beverage container holders be resistant to breakage under rough handling and use, as well as be economical, lightweight and compact in construction. It is also desirable that such holders be stable against tilting or spilling of the beverage during its consumption, particularly when they may be placed on uneven or unsteady surfaces for support, such as in boats, golf carts, and the like.

It is accordingly an object of the present invention to provide an improved portable insulated holder for beverage cans which is particularly adapted to maintaining the beverage in the can at a reduced temperature for extended periods of time during its consumption.

It is another object to provide an improved portable insulated holder for a beverage can which is of economical and lightweight construction, highly resistant to breakage by external force and pressure, and is readily stable and usable in outside environments, particularly during recreational activities.

It is a more specific object to provide an improved beverage can holder for maintaining chilled or cooled beverages in such condition for longer periods of time during their consumption, and which is particularly adapted to receive standard sized beverage cans.

It is a further object to provide an improved insulated holder for beverage cans which includes a refrigeratable substance which may be frozen or chilled to provide a positive cooling effect to the beverage, and which may be employed for longer periods of time to maintain cooled or chilled beverages colder, than those constructions believed available in the prior art.

It is a still further object to provide an insulated holder having refrigerant therein which can effectively retard warming of a chilled beverage even when the refrigerant reaches ambient temperatures.

These objects and other objects and advantages of the invention will be apparent from the following description.

SUMMARY OF THE INVENTION

The above and other beneficial objects and advantages are accomplished in accordance with the present invention by a holder comprised of two identical holding jackets and two identical refrigerant containers. Each holding jacket is an integral monolithic structure fabricated of a closed cell foam of a resilient polymeric material, and has a cylindrical sidewall, a substantially flat bottom closure wall, an open upper extremity defined by a flat circular end face disposed in a plane perpendicular to the axis of said sidewall, and a series of equally spaced grooves within the interior surface of said sidewall in parallel disposition to said axis and terminating in said open upper extremity. Each refrigerant container is comprised of a thin-walled can having a flat bottom, a cylindrical sidewall adapted to fit snugly within the sidewall of the jacket, and a flat closure lid. The can portion of the refrigerant container may be fabricated of thin-walled aluminum, or plastic materials such as polyethylene, polypropylene, and acrylonitrile-based copolymers currently used in the production of beverage bottles. The height of the refrigerant container, measured along the axis of its sidewall is between about 30% and 40% of the interior height of the jacket measured along the axis of the sidewall. The refrigerant container is adapted to reside within the jacket in abutment with the bottom closure wall. The remaining height within a jacket occupied by a refrigerant container is substantially half the height of a standard beverage can.

In a preferred embodiment, the interior of the jacket sidewall is outwardly flared at the upper extremity where it meets with the circular end face.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
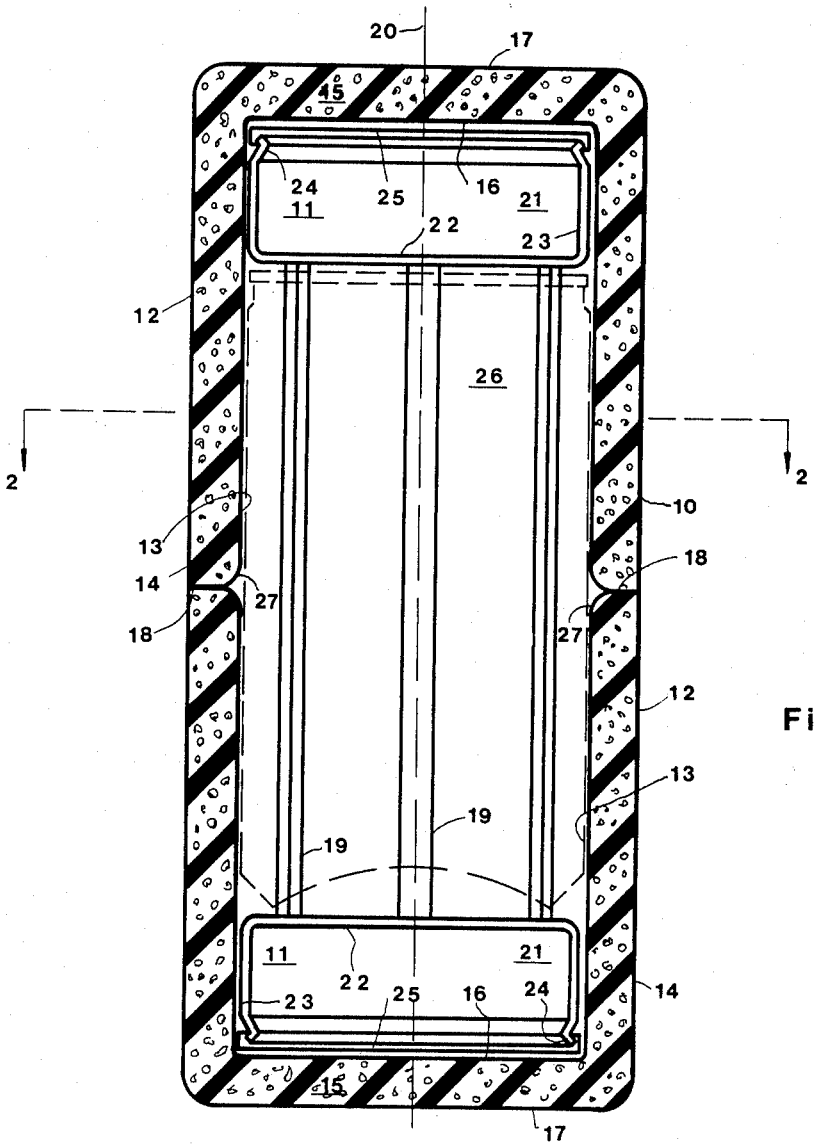
FIG. 1 is a sectional longitudinal view of an embodiment of the holder device of this invention showing positioned therein a beverage can of standard design.

For convenience in description, the terms "inner", "outer" or words of similar import will have reference to the geometric center of the device as shown in FIG. 1. Similarly, the expressions "upper " and "lower", or equivalents thereof will have reference to the upper and lower extremities, respectively, of the lower jacket illustrated in FIG. 1.

DESCRIPTION OF THE PREFERRED EMBODIMENT

Figure 2:
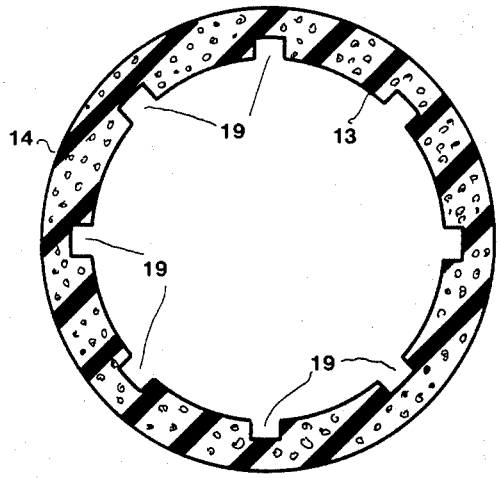
FIG. 2 is a sectional view taken along the line 2—2 of FIG. 1.
Figure 3:
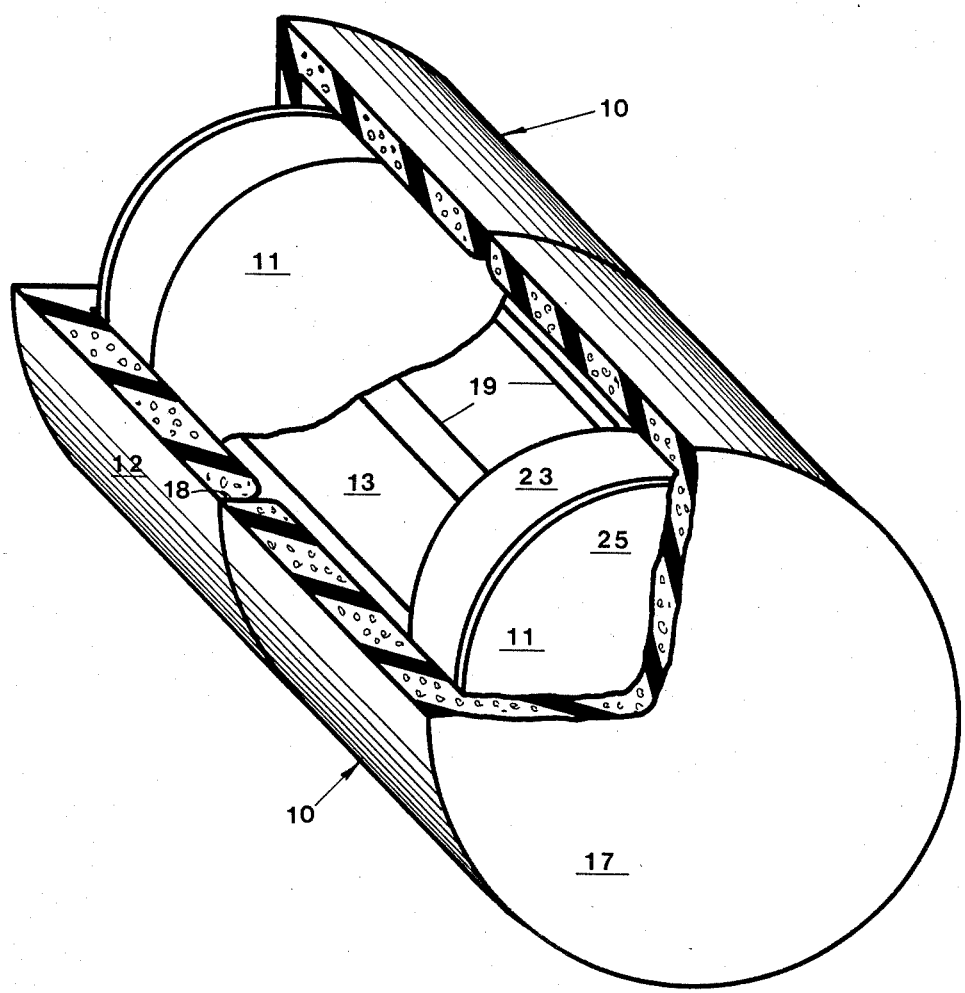
FIG. 3 is a perspective view of the device of FIG. 1 with portions cut away to reveal internal details.

Referring to FIGS. 1–3, an embodiment of the holder device of this invention is shown comprised of two identical holding jackets 10 and two identical refrigerant containers 11.

Each holding jacket is an integral monolithic structure fabricated of a closed cell foam of a resilient polymeric substance such as neoprene, interpolymers of ethylene and propylene, interpolymers of acrylonitrile, butadiene and styrene generally referred to as ABS polymers, polyurethanes, plasticized polyvinyl chloride, and the like. The jacket is comprised of cylindrical sidewall 12 having interior and exterior surfaces 13 and 14, respectively, bottom closure wall 15 having interior and exterior surfaces 16 and 17, respectively, and flat circular end face 18. The diameter of interior surface 13 is about 2.6 inches, thereby matching the outside diameter of aluminum beverage cans of currently standard design. The sidewall and bottom wall have a substantially equal and uniform thickness of between about $\frac{1}{4}''$ and $\frac{3}{4}''$. An outwardly flared rim 27 adjacent end face 18 facilitates insertion of beverage can 26 into the jacket.

A series of grooves 19 are recessed into the interior surface 13 of the sidewall in parallel disposition to center axis 20 of said sidewall, said grooves terminating in end face 18 and having a depth, measured radially with respect to said axis, between about 1/16" and $\frac{1}{8}''$. Between about 4 and 8 such grooves may be employed, each having a width between about $\frac{1}{8}''$ and $\frac{3}{8}''$. The grooves, having the aforesaid configuration, enable beverage can 26 to be inserted into the jacket in tight fitting engagement with interior surface 13 by permitting escape of entrapped air. The grooves further serve to promote convective cooling of the emplaced beverage can.

Each refrigerant container is comprised of a thin-walled can 21 having a flat bottom 22, a cylindrical sidewall 23 adapted to fit within interior surface 13 of the jacket, a rim 24 defining the open upper perimeter of sidewall 23, and a removable flat plastic lid 25 adapted to make a water-tight fit with said rim. The refrigerant container is adapted to rest against the interior surface 16 of the bottom closure wall of the jacket. The container engages the interior surface 13 of the jacket sidewall with sufficient frictional force to remain positioned upon the bottom wall even when inverted, yet can be removed from the jacket by the inertial force produced when the jacket is inverted and brought down forcefully upon a flat abutment surface. The configuration of the can portion of the container is such that the ratio of height/diameter ranges between about 0.5 and 0.8. The remaining height in a jacket having a properly positioned refrigerant container is such that, when two such jackets are brought together about opposite ends of beverage can 26, end faces 18 are in tight abutment, and the extremities of can 26 are in abutment with the refrigerant containers. The tight abutment of end faces 18 effectively prevents communication of the grooves with the exterior of the jacket.

In use, the containers may be filled with water or water-based refrigerant, and placed within the jackets which are then assembled about a beverage-containing can so that the entire assembly can be stored in a refrigerator. Alternatively, the jackets containing the refrigerant-loaded containers may be placed in a freezer to cause freezing of the refrigerant, and then installed upon a cooled beverage can. In a still further mode of operation, the refrigerant containers may be filled with ice and re-inserted into the jackets.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A thermally insulated holder for a single beverage-containing can comprising:

(a) two identical holding jackets, each being an integral monolithic structure fabricated of closed cell foam of a resilient polymeric material and having a cylindrical sidewall, a substantially flat bottom closure wall, an open upper extremity defined by a flat circular end face disposed in a plane perpendicular to the axis of said sidewall, and a series of equally spaced grooves within the interior surface of said sidewall in parallel disposition to said axis and terminating in said open upper extremity, and (b) two identical refrigerant containers, each comprised of a thin-walled can having a flat bottom, a cylindrical sidewall adapted to fit snugly within the sidewall of said jacket, and a flat closure lid, the height of the refrigerant container, measured along the axis of its sidewall being between about 30% and 40% of the interior height of the jacket, measured along the axis of the sidewall of the jacket, the ratio of height/diameter of said can being in the range of about 0.5 and 0.8, (c) each refrigerant container residing in abutment with the bottom closure of each jacket, whereby (d) when the two jackets are brought together about a beverage can, the can makes close-fitting contact with the interior surfaces of the sidewalls of the jacket, the top and bottom of the can contact the refrigerant containers, and the flat circular end faces of the jackets are in abutment.

2. The holder of claim 1 wherein the interior surface of the sidewall of said jacket is outwardly flared adjacent said flat end face.

3. The holder of claim 1 wherein said refrigerant container is provided with a circular rim defining the open upper extremity of the can and adapted to releasibly engage said plastic lid.

4. The holder of claim 1 wherein the sidewall and bottom wall of said jacket have a substantially equal and uniform thickness of between about $\frac{1}{4}''$ and $\frac{3}{4}''$.

* * * * *